US005408713A

United States Patent [19]

Stratton et al.

[11] Patent Number: 5,408,713

[45] Date of Patent: Apr. 25, 1995

[54] HEAD-REST

[75] Inventors: Paul Stratton, Safety Harbor, Fla.; David P. Wiesner, North Charleston, S.C.

[73] Assignee: Westcoast Med-Assist, Inc., Tampa, Fla.

[21] Appl. No.: 106,589

[22] Filed: Aug. 16, 1993

[51] Int. Cl.[6] ..... A61G 7/00

[52] U.S. Cl. ..... 5/632; 5/622; 5/657; 5/908

[58] Field of Search ..... 5/622, 623, 638, 640, 5/646, 657, 908, 632

[56] References Cited

U.S. PATENT DOCUMENTS

| | | | |
|---|---|---|---|
| 1,134,720 | 4/1915 | Bradley . | |
| 1,537,414 | 5/1925 | Darling . | |
| 2,947,009 | 8/1960 | McKenzie | 5/908 |
| 3,608,103 | 9/1971 | Seid | 5/623 |
| 4,074,374 | 2/1978 | Ayesh | 5/623 |
| 4,620,697 | 11/1986 | Pithon | 5/640 |
| 4,752,064 | 6/1988 | Voss . | |

FOREIGN PATENT DOCUMENTS 122855 8/1971 Norway .

*Primary Examiner*—Michael J. Milano
*Attorney, Agent, or Firm*—David Kiewit

[57] ABSTRACT

A system of head rests is disclosed for use by patients convalescing from optical surgery to re-attach a detached retina. In this procedure, a bubble of air is injected into the affected eye, and the patient is instructed to keep his or her head in a face-downward position for eighteen hours a day during a convalescent period in which the air bubble presses the retina against the back wall of the eyeball. A day-time version of the apparatus is adjustable in height and preferably incorporates armrests and a plurality of mirrors so that a person who has his face turned toward the floor may view television or may make eye contact with another person. A night-time version of the apparatus allows a person to lie in a prone position with his or her head supported above and out of contact with the mattress, and preferably includes a viewing window so that a prone patient can read a book placed on the floor.

4 Claims, 3 Drawing Sheets

HEAD-REST

BACKGROUND OF THE INVENTION

In new surgical procedures to re-attach a detached retina, a bubble of air is injected into the affected eye, and the patient is instructed to keep his or her head in a face-downward position for eighteen hours a day during a convalescent period of ten to twenty four days. During this period the air bubble presses the retina against the back wall of the eyeball. Maintaining the prescribed face-downward position for several weeks is difficult for the patient. This has created a need for a system for both, day and night use.

Prior art head-rests used to maintain a patient's head in a face-downward position include:

U.S. Pat No. 1,134,720, wherein Bradley teaches a head rest fastened to a bed frame to allow a person to sit with his or her head supported in a generally downward-looking attitude. Bradley's device includes a desk-like surface that can be used as a work surface or as an arm-rest.

U.S. Pat No. 1,537,414, wherein Darling teaches a combination of a modified mattress and several pillows to allow a person to rest or sleep in a prone position with his or her head supported above and out of contact with the mattress.

U.S. Pat No. 4,752,064, wherein Voss teaches a pillow and related devices for use by a patient in a prone position on a surgical operating table. Voss" teaching includes a repositionable mirror that allows a physician to view the patient's face.

SUMMARY OF THE INVENTION

It is an object of the invention to provide a post-operative support system that allows a patient to continuously maintain a face-down position with minimum discomfort.

It is a further object of the invention to provide a head-rest adjustable in height so that it may be used by a person who is in a sitting position.

It is yet a further object of the invention to provide a head-rest apparatus that incorporates adjustable mirrors so that a person who has his face turned toward the floor may view television or may make eye contact with another person.

It is an additional object of the invention to provide apparatus incorporating a head-rest and a working surface or arm-rests.

It is yet an additional object of the invention to provide apparatus incorporating both a head-rest and a receptacle that may be used to hold various objects, such as a drinking cup, writing implements, a portable telephone, or a remote controller for a television receiver.

DETAILED DESCRIPTION

Figure 1:
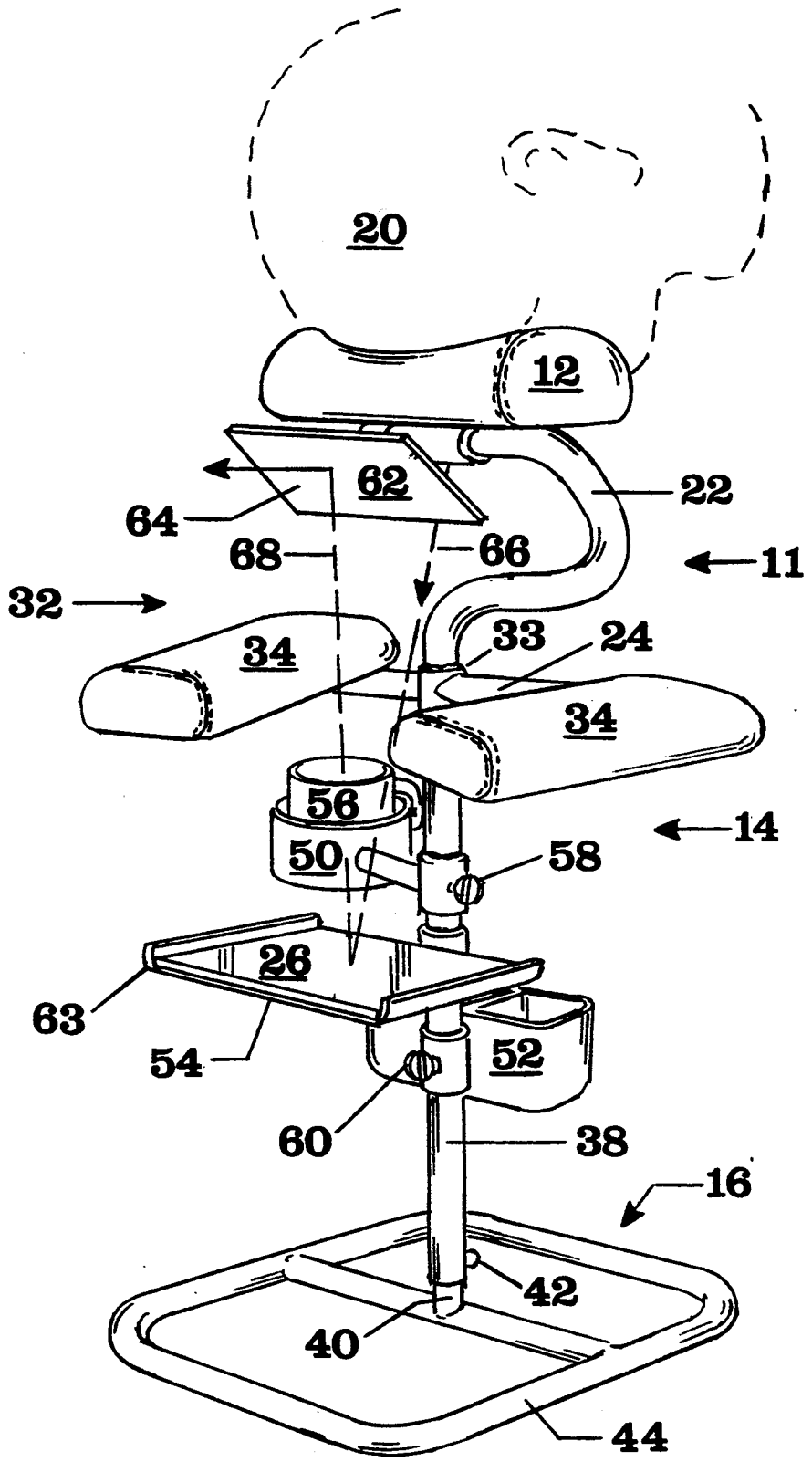
FIG. 1 of the drawing is an elevational view of one version of a head-rest apparatus configured for daytime use.

Turning initially to FIG. 1 of the drawing, one finds a headrest 10 that may be used during the daytime by a person convalescing from an eye surgery such as the procedure known as pneumatic retinoplexy. The preferred apparatus includes a pillow 12, a generally vertical pillow support column 14 that includes a bent or curved section 22, a base 16, and a variety of items that can be attached to the pillow support member 14 as will be discussed subsequently herein.

The pillow 12 preferably includes a rigid bottom surface that is attachable to the support 14 by screws or other known means; a compliant filing, such as a sponge rubber or urethane foam; and an outer covering (e.g. vinyl plastic) that is sewn or otherwise formed over the foam. As shown in FIG. 1, this pillow 12 may be used by a patient 20 who rests his/her forehead on the pillow 12 with his/her eyes facing generally downward. The pillow 12 is preferably rotatable about the portion of the column 14 to which it is attached, e.g., by the use of a mounting sleeve 23 that can be fixed into a chosen position by tightening a set screw 25.

Figure 3:
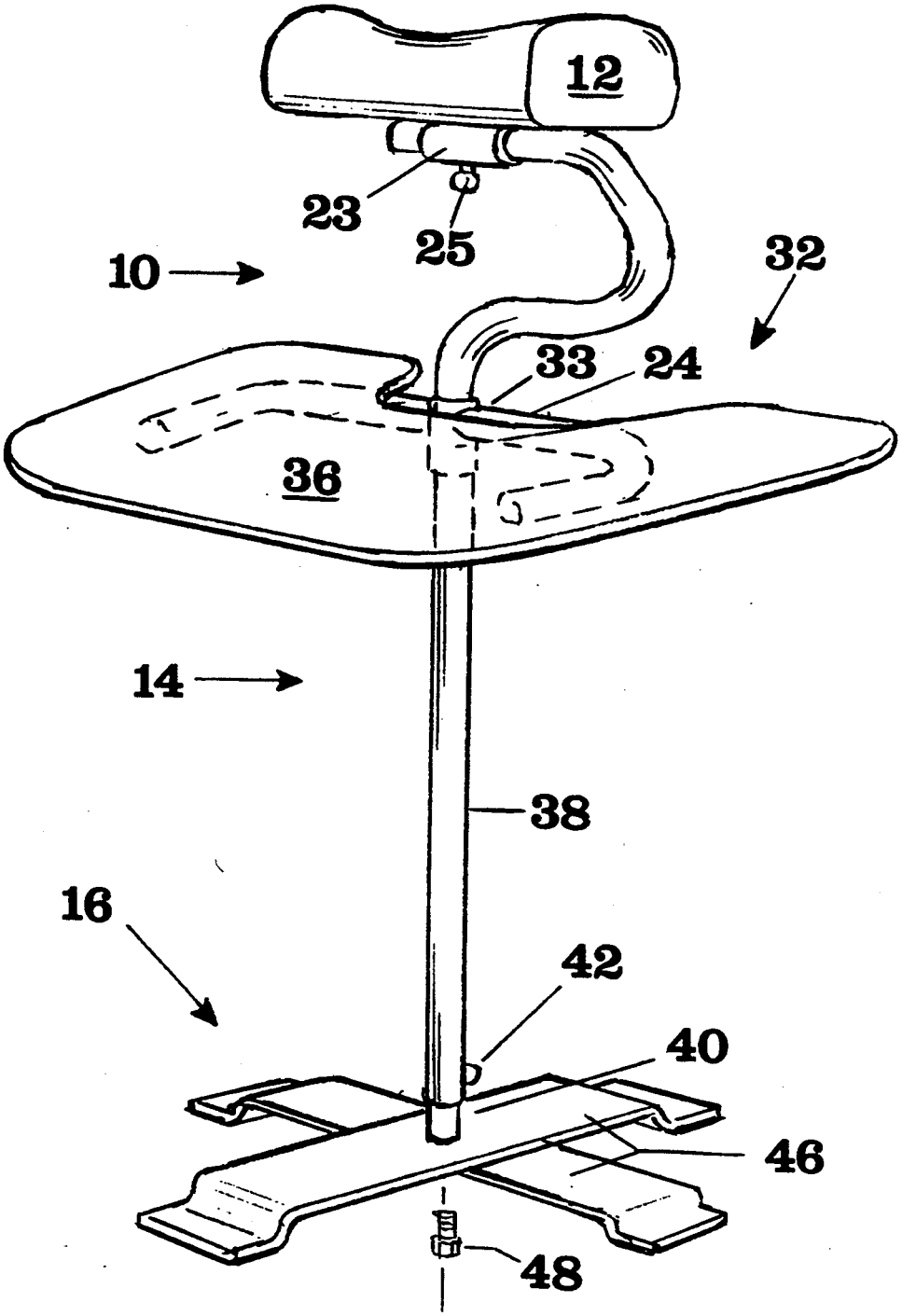
FIG. 3 the drawing is an elevational view of a second version of a head-rest apparatus configured for daytime use.

The single column 14 preferably includes a bent section 22 that is generally intermediate between the pillow 12 and a cross-piece 24. This bent section 22 is introduced to provide the patient 20 with a clear line of sight toward a horizontal surface member such as a mirror 26, a work surface, or another object generally below the level of the patient's head. The bent section 22 is usually curved toward the left side of the patient's 20 body, as shown in FIGS. 1 and 3, so as to minimize the interference of this member with motion of the patient's right hand. It will be understood that the apparatus can also be configured for use with a left-handed patient by rotating the various items attached to the vertical support 14 about that support so as to place the bent section 22 on the patient's right side. Alternately, the vertical support 14 can include a bent section that extends generally away from the patient's body.

The daytime head-rest apparatus of the invention also includes arm-rest means 32 supported by a cross-piece 24 that is preferably attached to the column 14 by a joint 33 that, when released, allows the cross-piece 24 to be both translated along and rotated about the axis of the support 14. Alternately, the cross-piece can be permanently attached to the support 14 by brazing or the like. The arm-rest means 32 may have any of a number of configurations, such as the pair of arm-rest pillows 34 shown in FIG. 1, the desk 36 shown in FIG. 3, etc.

The daytime head-rest apparatus of the invention can be adapted to a given patient or to different uses by a given user by means of several adjustments. One of these adjustments, as discussed above, consists of translating the arm-rest 32 along the support 14 so as to vary the distance between the arm-rest means 32 and the pillow 12. Raising or lowering the pillow 12 above the base 16 is another important adjustment that accommodates the apparatus to users of differing heights. This height adjustment is preferably provided by making the vertical support 14 of two tubular members 38, 40 that telescope and that can be locked at a plurality of positions.

The height adjustment of the support 14 can be provided by a number of means, including using a screw that passes through a threaded hole in the outer tube 38 to engage the inner tube 40; using threaded surfaces on the two tubes, etc. This height adjustment is preferably provided by a spring-biased detent 42 internal to the inner tube 40, that extends through a hole in the inner tube 40 to engage a through-bore in the outer tube 38. This method of height adjustment is well known in the art and is described, inter alia, by Jong in U.S. Pat No. 4,094, 330, the disclosure of which is herein incorporated by reference.

Figure 2:
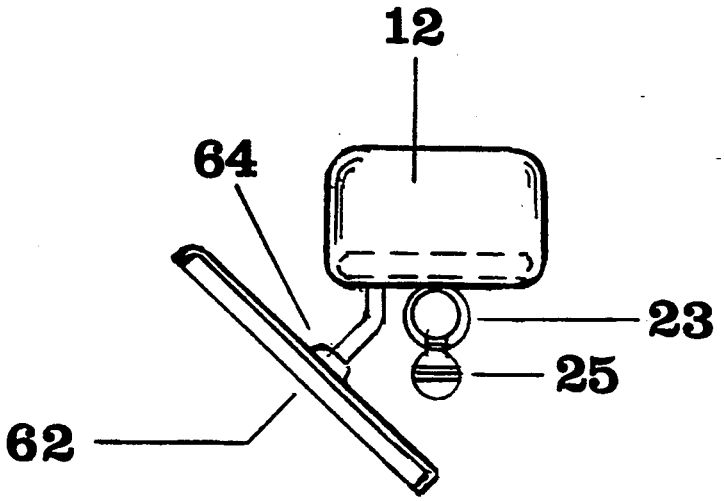
FIG. 2 of the drawing is a side elevational view of the forehead support and adjustable mirror portions of the apparatus shown in FIG.

The base 16 of the head-rest apparatus 10 may have a number of configurations. Generally speaking, this base is made wide enough so that the apparatus does not tip over too easily, but is made narrow enough so as to not impede the free motion of the user's feet. In a preferred embodiment, a base width of about 40 cm and an overall height of about 80 cm have been found to be useful. This base 16 may be conveniently made of the same sort of tubing 44 used in the support 14, or may be made of metal straps 46, as shown in FIG. 2. A base made of metal straps 46 may be configured to be readily demountable for transport or storage— e.g. may fasten together with a bolt 48, or the like, as shown in FIG. 2.

For the convenience of the user, the head-rest apparatus 10 can incorporate a number of receptacles 50, 52, trays 54, work surfaces, etc. These can include a cup receptacle 50, configured for holding a coffee cup 56 or the like, that may be mounted to the vertical support 14 with a sliding collar 58 secured by a thumb-screw; a general-purpose bin or receptacle 52 that is secured to the vertical support 14 in a like manner with a clamp 60; as well as a writing surface or tray retainer 54, either of which may be used as a book support.

One of the drawbacks to using a head support that keeps one in a face-downward position is that it is difficult to make eye contact with another person, or to watch television. In a preferred version of the head-rest apparatus 10, this problem is addressed by the provision of two mirrors 26, 62, at least one of which is rotatable about a horizontal axis. As is indicated schematically in FIG. 2 of the drawing, the patient 20 can manually rotate a tiltable upper mirror 62 about a hinge axis 64 so that his or her line of sight (indicated by dot-dash lines 66, 68 FIG. 1) intercepts a television receiver or a companion. As is well-know in the art, the desired control of viewing direction could be offered by a ball-and-socket joint on the upper mirror 62 instead of the hinge 64. Although the mirror 26, is shown in FIG. 1 of the drawing as being insertable into a retaining slot 63 in tray retainer 54, it will be understood that a wide variety of other approaches to providing the lower mirror 26 (e.g. a separate fixed mirror, a mirror that is mounted on a rotatable axis or joint as is provided for the upper mirror 62 in FIGS. 1 and 2) can be considered. It is additionally notable with respect to the view of FIG. 1 that the mirror 26 can be used as a tray, book support or the like.

The use of two mirrors for viewing distant objects provides the advantage that enantiomorphic objects form images that have the correct sense—i.e. the double reflection presents objects on the patient's right in the right hand side of the image field.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is desired to be secured by Letters Patent is:

We claim:

1. Head rest apparatus maintaining a user's head in a face-downward attitude, said apparatus comprising a base supporting said apparatus above a horizontal surface, a single column comprising a first, vertical, portion extending upwards from said base to a horizontal cross-piece, said column further comprising a second curved portion extending vertically and laterally intermediate said cross-piece and a pillow, arm rest means attached to said cross-piece, and a generally horizontal surface member below said pillow, wherein said pillow is attached to said column adjacent an upper end thereof so that a line of sight extending from said pillow to said horizontal surface member does not intercept said second curved portion of said column.

2. A head rest of claim 1 wherein said horizontal cross-piece is rotatably attached to said column, whereby said apparatus is adaptable for use by a right-handed or by a left-handed user.

3. A head rest of claim 1 wherein said horizontal cross-piece is slideably attached to said column, whereby a distance between said arm rest means and said base may be adjusted.

4. Head rest apparatus of claim 1 wherein said horizontal surface member comprises a first mirror, said apparatus further comprising a second mirror attached adjacent said pillow, said second mirror rotating about a horizontal axis.

* * * * *